US006333072B1

(12) United States Patent
Lane et al.

(10) Patent No.: US 6,333,072 B1
(45) Date of Patent: Dec. 25, 2001

(54) METHOD OF PRODUCING ADHERENT METAL OXIDE COATINGS ON METALLIC SURFACES

(75) Inventors: Michael H. Lane, Clifton Park, NY (US); Robert D. Varrin, Jr., McLean, VA (US)

(73) Assignee: The United States of America as represented by the Department of Energy, Washington, DC (US)

( * ) Notice: Subject to any disclaimer, the term of this patent is extended or adjusted under 35 U.S.C. 154(b) by 0 days.

(21) Appl. No.: 09/471,115

(22) Filed: Dec. 23, 1999

(51) Int. Cl.[7] ..... B05D 1/00; B05D 3/02; C23C 24/00

(52) U.S. Cl. ..... 427/190; 427/191; 427/201; 427/331

(58) Field of Search ..... 427/190, 191, 427/201, 331, 427

(56) References Cited

U.S. PATENT DOCUMENTS 1,761,186 6/1930 Baker et al. .
4,643,778 2/1987 Donofrio .
5,279,650 * 1/1994 Stetson et al. ..... 106/141.2
5,560,883 10/1996 Lane et al. .
5,620,645 4/1997 Crumpacker et al. .

OTHER PUBLICATIONS

"Ceramic Coatings and Linings", *ASM Handbook,* vol. 5, Surface Engineering, pp. 469–473, Pub. ASM International, 1994 (no month).

* cited by examiner

*Primary Examiner*—John J. Zimmerman
*Assistant Examiner*—Andrew T. Piziali
(74) *Attorney, Agent, or Firm*—Virginia B. Caress; Paul A. Gottlieb

(57) ABSTRACT

Provided is a process of producing an adherent synthetic corrosion product (sludge) coating on metallic surfaces. The method involves a chemical reaction between a dry solid powder mixture of at least one reactive metal oxide with orthophosphoric acid to produce a coating in which the particles are bound together and the matrix is adherent to the metallic surface.

25 Claims, No Drawings

METHOD OF PRODUCING ADHERENT METAL OXIDE COATINGS ON METALLIC SURFACES

This application contains subject matter relating to Department of Energy Contract No. DE-AC12-76SN00052.

A. FIELD OF THE INVENTION

The invention relates to a process for producing adherent metal oxide coatings on metallic surfaces. More particularly, the invention relates to the production of an adherent, porous, metal oxide coating on metallic surfaces for the purpose of (1 ) testing, such as for heat transfer or corrosion of the underlying metallic material, (2) improving the surface characteristics to perform a specific function, such as changing the heat transfer characteristics or optical properties, or (3) protecting the metallic surface from environmental degradation.

B. BACKGROUND OF THE INVENTION

Processes for simulating corrosion product deposits (sludge) are now well known. In one known method, alumina silicate binders are combined with dry powder mixtures of metal oxides, mineral species and metals, such as copper or zinc, in order to form coatings of synthetic deposits. The synthetic deposits based on alumino silicate binders have been previously used for chemical and mechanical cleaning qualification programs. The known process may be used to simulate corrosion product depositions on both flat and curved surfaces. However, these alumino silicate based deposits lack sufficient consolidation, strength and water resistance for many heat transfer test purposes. Consequently, there is a need for a process of forming an adherent metal oxide coating that can withstand severe flow boiling conditions up to about 200,000 BTU/hr·ft$^2$ heat flux. One such process described herein is based on the use of an orthophosphoric acid binder with mixed metallic oxide and metal powders.

The use of orthophosphoric acid for consolidating some oxides is briefly discussed in ASM Handbook Volume 5, Surface Engineering (page 472, published by ASM international, copyright 1994). In the ASM Handbook, the oxides used are limited to aluminum oxide, zinc oxide, hafnium oxide, and zirconium oxide.

U.S. Pat. No. 5,620,645 discloses mixing metal or metal compounds with orthophosphoric acid and then adding a moldable filler material, usually refractory in nature. Preferred materials include aluminum hydroxide, chromium trioxide, magnesium oxide, and zinc oxide, The mixture is placed in a mold and dried at a temperature of less than 100° C. to remove water and harden the material, The material is then oven dried at 300° C. where additional water is driven off and the mixture is pressed into its final configuration and desired porosity. The liberation of $H_2$ gas and the resulting increase in porosity caused by the reaction of orthophosphoric acid and metal species is either not desired or useless to the method described in this patent. This patent also makes no direct or indirect reference to simulation of heat-exchanger deposits.

U.S. Pat. No. 1,761,186 discloses dipping, repeatedly, if desired a ferrous material heated to 500° F. (260° C.) in an orthophosphoric acid solution to apply a relatively thin, rust inhibitive coating of ferrous-ferric oxide directly on the ferrous material. The coating is then oven dried. It is contemplated that dissolving manganese, zinc or iron phosphate in the acid could result in these rust inhibiting compounds forming part of the coating. Porous coatings are not desired for such an application. The use of a phosphoric acid solution to rust-proof steel surfaces is, according to the description in this patent, an established part of the prior art. However, the stated purpose of the described process is to create a phosphatic, rust-inhibiting, coating.

U.S. Pat. No. 4,643,778 is similar to U.S. Pat. No. 1,761,186 in that a thin coating is chemically formed directly on the base metal by dipping the material in a solution of phosphoric acid In this case, the film or coating formed allows adherence of paint. The coating formed is either zinc phosphate or iron phosphate. The relevant properties of the zinc phosphate or iron phosphate coatings that result from the process described in the patent concern only the corrosion protection provided.

SUMMARY OF THE INVENTION

The principle objective of the invention is to provide a process for forming an adherent metal oxide coating that can withstand severe flow boiling conditions of about 200,000 BTU/hr·ft$^2$ heat flux for the purpose of conducting heat transfer or corrosion testing. Other objectives include modifying the optical and heat transfer properties or corrosion resistance of the metallic surface.

Another objective of the invention is to provide an adherent metal oxide coating that can withstand severe flow boiling conditions of about 200,000 BTU/hr·ft$^2$ heat flux.

The present invention provides a novel process for forming an adherent metal oxide coating on a metallic surface comprising the steps of:

- providing at least one reactive metal oxide selected from the group consisting of iron oxides, nickel oxides, ferrite compounds, and zinc oxides typically having an average particle diameter of from about 1 to about 10 $\mu$m and an average surface area of from about 0.5 to about 5 m$^2$ /gram;
- combining phosphoric acid with at least one said reactive metal oxide to form a coating mixture where phosphoric acid is added in an amount to provide a porosity of about 20 to about 80% in the adherent metal oxide coating; and
- applying the coating mixture to a metallic surface and heating said coating to form an adherent metal oxide coating on the metallic surface.

The present invention also provides an adherent metal oxide coating on a metallic surface, said adherent metal oxide coating comprising;

- at least one reactive metal oxide selected from the group consisting of iron oxides, nickel oxides, ferrite compounds, and zinc oxides, having an average particle diameter of from about 1 to about 10 $\mu$m and an average surface area of from about 0.5 to about 5 m$^2$/gram; and
- at least one metal phosphate selected from the group consisting of iron phosphates, nickel phosphates and zinc phosphates, binding said reactive metal oxide together in a coating having a porosity of about 20 to about 80%.

The advantages of the present process includes the creation of an adherent metal oxide coating that can withstand severe flow boiling conditions of about 200,000 BTU/hr·ft$^2$ heat flux, the formation of a porous deposit, and the ability to create deposits up to about 50+ mils thick on either a flat or curved surface.

DETAILED DESCRIPTION

The present invention provides a process of producing an adherent synthetic corrosion product coating on metallic surfaces. The method includes a reaction between a dry solid powder mixture of at least one reactive metal oxide and deposit precursor with orthophosphoric acid (hereinafter referred to as "phosphoric acid"). Examples of reactive metal oxides are iron oxides, nickel oxides, ferrite compounds (e.g., nickel ferrites) and zinc oxides. Examples of deposit precursors are metal oxides, mineral species and pure metals. The phosphoric acid reacts with the reactive metal oxide of the mixture to form an inter-particle binder species of metal phosphates. If iron oxide is used as the reactive metal oxide, $Fe(H_2PO_4)_2$ and other iron phosphate species will be formed by the reaction with phosphoric acid. Hydrogen gas may also be liberated by the reaction which, upon release from the mixture prior to drying, causes pores to form in the final coating matrix. It has been found that successful consolidation, binding and adherence of the coating to the metallic surface requires precise control of the ratio of phosphoric acid to specific surface area of the dry deposit powders prior to reaction.

Use of too little phosphoric acid results in incomplete consolidation and a loosely adherent coating. Too much phosphoric acid results in a mixture which reacts too quickly to be useful for deposition and a coating which has little or no porosity. The phosphoric acid can be varied to provide a porosity between about 20% to about 50% in the adherent metal oxide coating. Porosities of up to 80% in the adherent metal oxide coating can be achieved when a preconsolidation process is used. The formed metal oxide coating can be heat treated to ensure the reaction is complete and the coating is appropriately consolidated.

An advantage of this process is that the process results in an adherent coating with thicknesses of up to 50+ mils thick on either a flat or curved surface using the process herein by reference.

The novel adherent metal oxide coating can be formed by the following preferred process.

Step 1:

The composition and physical properties of the target final product coating (hereinafter referred to as "target coating") are established.

Usually, this includes specifying the chemical composition, such as percent nickel ferrite, iron oxides, other metal oxides, pure metal species, and hardness species, as well as the desired thickness, porosity, pore size distribution and specific surface area. Typical values for porosity, pore size distribution and specific surface area are:

Porosity: about 20 to about 80%

Pore size distribution: Average about 0.1 to about 0.7 $\mu$m or Bimodal with chimneys at ~7 $\mu$m diameter and small pores at about 0.1 to about 0.7 $\mu$m Particle size: about 1 to about 10 $\mu$m Specific surface area: about 0.5 to about 5 $m^2$/gram Chimneys are cylindrical pores generally aligned perpendicular to the metal surface that during heat transfer allow steam to escape through the coating to an aqueous media.

Step 2:

Provide the ingredients (i.e., reactive metal oxides and deposit precursors), of the oxide mixture. The reactive metal oxides and precursors are commercially available and are typically available as high purity (>99% pure) dry powders with particles sizes from 0.1 to 10 $\mu$m. A preferred oxide mixture (also referred to as "coating formula") consists of reactive metal oxides of magnetite (about 63 wt % $Fe_3O_4$), hematite (about 21 wt % $Fe_2O_3$) and nickel oxide (about 4 wt % NiO), and precursors of about 5 wt % copper oxides, and less than 1 wt % each of other metallic oxides.

Step 3:

Based on the comparison between the physical properties of the ingredients of the oxide mixture and the desired physical properties of the target coating, one of two options for preparation of the oxide mixture is selected:

Option 1

If the weight-average particle size and the weight-average specific surface area of the ingredients of the oxide mixture (as received from the suppliers) are within desired ranges, all ingredients are combined and ball milled for no less than 24 hours in a non-aqueous solvent, such as high purity methanol. The mixture is then dried under vacuum to provide a dry powder mixture.

Option 2:

If the weight average particle size or specific surface area of the ingredients of the oxide mixture is significantly different from the desired values, a "pre-consolidation" process is used for all or some of the ingredients of the oxide mixture. Usually, Option 2 is used when the particle size of the as-received ingredients of the oxide mixture are significantly lower (e.g., <1 $\mu$) than that desired in the target coating or the specific surface areas of the ingredients of the oxide mixture are significantly higher (e.g., >5 $m^2$/gram) than that desired in the target coating. For example, hematite and magnetite, often used as reactive metal oxides, may only be available in high purity form as 0.1 to 0.3 $\mu$m particles with a specific surface area of 8 $m^2$/gram or greater. Use of such material as-received results in a fine grained coating with only small diameter pores (typically less than 0.2 $\mu$m). The high specific surface area of the magnetite or hematite also requires higher concentrations or quantities of phosphoric acid for binding since the reactive surface area is greater. This often renders deposition of oxide mixtures of these materials to be impractical since higher concentrations of phosphoric acid result in unacceptably fast reaction times and excessive heat generation which accelerates the reaction rates further.

Pre-consolidation comprises mixing in a reaction vessel the ingredients of the oxide mixture in a correct weight ratio with orthophosphoric acid which reacts to "consolidate" the oxide mixture. Generally, the orthophosphoric acid is diluted with water to facilitate control of the reaction rate. The pre-consolidation process is usually performed with a more concentrated phosphoric acid solution than that used for the final deposition of the synthetic coating. Pre-consolidation is generally accomplished using about a 2:1 to 3:1 diluted phosphoric acid in a ratio of about 0.5 to about 0.7 ml dilute acid per gram of dry powder. (Final deposition is generally accomplished using about 4:1 to 7:1 diluted phosphoric acid in a ratio of about 0.5 to 0.7 ml dilute acid per gram of dry powder.)

The oxide mixture is then often heat treated to further promote the consolidation process and obtain complete consolidation to a solid mass. The heat treatment should be a gradual incremental process starting at about 90° C. and going up to about 260° C., in steps of approximately 30–40 degrees. The heat treatment should last from about 6 to 24 hours. For example, the mixture can be heat treated for nominally 1 hour each (but up to 4 hours each) at about 90° C., 120° C., 150° C., 190° C., 220° C. and 260° C. followed by a slow oven cooling for 12 hours. This heat treatment improves the hardness and consolidation of the pre-consolidated product prior to grinding and sieving to the desired particle size. The heat treatment is not limited to the preferred temperatures disclosed, but may be conducted as desired for the particular application.

The consolidated mixture is then ground and sieved to produce a pre-consolidated powder with the desired particle size and surface area. If the pre-consolidation process was used for only some of the ingredients of the oxide mixture, then the pre-consolidated powder is mixed with the remaining ingredients of the oxide mixture. The oxide mixture is ball milled and dried for 24 hours. The final dry powder mixture exhibits the final desired particle size and specific surface area of the target coating and is suitable for formation of adherent metal oxide coatings.

Pre-consolidation also allows for more complete dispersion of metal species such as copper which, when added without preconsolidation, tends to separate from the mixture suspension when phosphoric acid is added.

Pre-consolidation also allows porosities of up to 80% in the adherent metal oxide coating to be achieved.

Pre-consolidation also helps achieve a desirable bi-modal coating porosity distribution since the preconsolidated mixture can be formed with a distribution of small, 0.1 to 0.3 $\mu$m, pores. The bonded pre-consolidated powder then fuses by reaction with the phosphoric acid to form interparticle pores with diameters of about 1 $\mu$m to about 7 $\mu$m.

Step 4:

A portion of the dry powder mixture is weighed and transferred to a reaction vessel. For a typical experiment involving deposition on the inside diameter of an 18 inch long 5/16" inside diameter (ID) tube, 15 grams of dry powder are usually used. For a small test coupon, on the order of 1 gram dry powder is usually used.

On a per gram basis, a typical dry powder mixture contains about 0.006 moles of metal oxides and metals per gram. Based on testing of the reactivity of the individual ingredients of the preferred oxide mixture (as described above) with orthophosphoric acid, it has been found that on the order to 50% to 80% of the ingredients react at their surfaces with the acid during the formation of the synthetic coating. Examples of reactive metal oxides are iron oxides, nickel oxides, zinc oxides and ferrite compounds. Preferred examples of reactive metal oxides include magnetite and nickel ferrite. Mildly reactive metal oxides include copper oxide and hematite. Non-reactive species include copper metal. On an elemental basis, a gram of dry powder mixture contains about 0.003 moles of reactive metal oxide, or on the order of 0.009 moles as the reactive element (as iron, nickel or zinc).

Step 5:

For each gram of dry powder mixture (which contains on the order of 0.009 moles of reactive elements), about 0.5 to about 0.7 ml of phosphoric acid diluted in a ratio (by volume) of from about 4:1 to about 7:1 (water to 85% orthophosphoric acid), and preferably on the order of 5.5:1, is used for the adherent metal oxide coating formation. The diluted acid mixture and powder can be thoroughly mixed in a glass or polyethylene container with a Teflon®-coated spatula. The consistency of the mixture is usually similar to that of printing ink. The shelf life of the mixture should be approximately 20 to 40 minutes (and is less for water to acid ratios less than 4:1) at room temperature, after which the consolidation reactions and evaporation of water increase the viscosity to a point where application by calendaring, injection into the ID of tubes, or brushing is impractical.

If too high a concentration of phosphoric acid is used (based on the desired physical properties of the target coating), the phosphoric acid reaction will be accelerated, resulting in a very low porosity, glossy coating. For example, when the water:acid concentration is 1:1, consolidation occurs in as little as a few minutes. If too little acid is used, a coating results that is not completely consolidated and loosely adherent. Therefore, the coating will not be able to stand up to the vigorous testing or application required.

Step 6:

Adding 1 or 2% by weight zinc or iron powder to the mixture may also be used to enhance the process if trials show the consolidated mixture does not meet the final desired physical properties, such as porosity. Adding the metallic powder speeds up the phosphoric acid reaction resulting in the liberation of more heat and $H_2$ gas. Too much metallic powder can cause the formation of a brittle, glossy type coating that is not considered useful for heat transfer testing. If iron powder is used, care must be taken to prevent its premature oxidation, as this would reduce its reaction rate with the phosphoric acid. Storage under an inert gas like Argon gas aids to prevent premature oxidation.

Step 7:

After mixing the dilute phosphoric acid with the dry powder mixture components, the mixture can be applied to a properly prepared metallic surface including that of tubes or coupons. Examples of suitable metallic surfaces include, but are not limited to, nickel based alloys including Alloy 600, Alloy 625, Alloy 690; stainless steels; and carbon steel surfaces. Prior to coating, the surfaces can be cleaned and in some cases (such as with Alloy 625), plated with a thin layer of zinc metal to aid in coating adherence. To apply a zinc plate, a pure nickel strike can be laid down to improve the zinc plating adherence. The reaction and binding with a zinc plating could also allow the coating of similar powders on surfaces other than metallic ones, like plastics that have had a metallic plating applied.

Step 8:

Upon completion of the application of the coating mixture, the synthetic coating should be air dried for up to 24 hours. The air dry can be followed by a heat treatment. An example of a suitable heat treatment comprises the following steps:

1 to 4 hours at 90° C.

1 hour at each of 120, 150, 190, 220, 260; and 290° C.

Slow oven cooling for 12 hours

The heat treatment can be performed in air or under an inert gas, such as a nitrogen blanket. The nitrogen blanket can be used when it is necessary to prevent oxidation of copper metal species such as would be the case if the coating were to be used for corrosion testing. Copper oxides are known to increase the electrochemical potential at the metal surface in aqueous environments, which can increase the potential for intergranular attack or intergranular stress corrosion cracking of the metal.

The present invention uses a much different process from prior art with alumino-silicate binders, producing an adherent metal oxide based coating capable of withstanding severe flow boiling conditions at elevated temperatures (450+°F.) and pressures (450+psia). Precisely controlling the phosphoric acid to reactive metal oxide and precursor specific surface area ratio is key (through preconsolidation, if necessary) to controlling the rate of reaction. Controlling these variables allows time to apply the coating and the ability to vary the porosity of the final coatings.

The advantages of this method are that the process results in the creation of an adherent metal oxide coating that can withstand severe flow boiling conditions of 200,000 BTU/hr·ft$^2$ heat flux, the formation of a porous coating, and coatings up to 50+mils thick on either a flat or curved surface can be formed.

The present invention will now be explained with reference to the following non-limiting examples.

EXAMPLE

Formation of Oxide Coatings on Flat or Curved Surfaces (Tube I.D. or O.D.)

| Coating Formula (1 g powder) | Average Skeletal Density (g/cc) | Total Moles/ Gram | Re-active Moles/ Gram | Reactive Surface Area ($m^2$/gram) | Typical Moles $H_3PO_4$ |
|---|---|---|---|---|---|
| A | 5.27 | 0.00602 | 0.0031 | 4.42 | 0.0013 |
| A + 15% $Fe_3O_4$ | 5.25 | 0.00578 | 0.0035 | 3.9 | 0.0013 |
| B | 5.65 | 0.00626 | 0.0034 | 0.80 | 0.0013 |
| A Precon | 5.27 | 0.00602 | 0.0031 | 4.42 | 0.0034 |
| A Precon + 15% $Fe_3O_4$ | 5.25 | 0.00578 | 0.00065 | 0.14 | 0.0013 |

Reactive moles means the potential moles (subset of total) that may react with phosphoric acid to bind together.

Formula A is a mixture of metal oxides with the following major constituents: 63.2 wt.% $Fe_3O_4$, 21 wt. % $Fe_2O_3$, 4.3 wt. % NiO, 1.8 wt. % CuO, 1.8 wt. % $Cu_2O$, 1.2 wt. % Cu, less than 1% others, based on the total weight of the mixture.

Formula B is a mixture of metal/metal oxides with the following major constituents: 18.9 wt. % Cu, 3.7 wt. % CuO, and 77.4 wt. % $Ni_{0.4}Fe_{2.6}O_4$, based on the total weight of the mixture.

Precon means preconsolidated by first reacting the metal oxide mixture with phosphoric acid then grinding to achieve various porosities.

In the above example, a variety of synthetic oxide coatings were applied to flat metal surfaces, typically circular disks of a nickel-based alloy such as Alloy 600 and Alloy 625. Formation of these coatings on such metal "coupons" facilitates the study of the thermal properties of the deposits. More specifically, these coupons may be affixed to a heated surface and placed underwater to establish the degradation of or enhancement to heat transfer due to the presence of the deposits. Typically, thin (less than 100 $\mu$m) layers of deposits formed in the above manner with coating formulas A or B or their variants have been shown to increase heat transfer rates. Coatings of the above with a thickness greater than 100 $\mu$m have been shown to degrade heat transfer.

TUBE SURFACE PREPARATION

Prior to the deposition process, the tubes were prepared by applying a zinc plating. A preliminary nickel strike on the tube ID surfaces was used to increase the zinc plating adherence.

DEPOSIT MATERIAL

Large hematite particles (1–3 $\mu$m rather than the typical 0.1–0.3 $\mu$m) ground from solid mineral hematite materials were used in coating formula A which reduced the specific surface area of the oxide powder mixture, thereby facilitating the binding of the coating particles during preparation. In addition, smaller copper particles (<5 $\mu$m rather than typical 10–25 $\mu$m) were used in order to improve the injection process.

COATING PREPARATION PROCEDURE

The following steps were used to prepare the oxide powder mixture, which was formulated using coating formula A.

1. A 3:1 ratio mixture of water and phosphoric acid (85% strength) was prepared.
2. The coating formula A ball-milled powder was mixed with the water-acid mixture in the ratio of 1.4 grams of solid to 1 gram of liquid.
3. This mixture hardened within 5 to 7 minutes when the reaction was complete.
4. A consolidation heat treatment was performed as follows;

Heat 4 hours at 90° C.

Heat 1 hour at each of 110° C., 150° C., 190° C., 220° C., and 260° C.

Oven cool to room temperature.

5. The material was ground in a hammer mill and then ground further with a mortar and pestle.

6 The resultant powder was ground in a ball mill with methanol or acetone. The particle size was a relatively uniform 1–3 $\mu$m.

The following steps were then implemented in order to deposit a coating layer on the tube ID surfaces.

1. The Alloy 625 tube was cleaned with deionized water, 10% citric acid solution (Alconox/Citrox® brand cleaner), and 10% sodium carbonate for approximately 10 seconds.
2. The tube was then rinsed in deionized water and dried using compressed $N_2$ or He.
3. A copper tube that forms an annular gap with the I.D. of the Alloy 625 tube with the appropriate outer diameter for the desired coating thickness was selected. For the nominally 0.320" ID Alloy 625 tubes, copper tube outer diameters which were about 4 mils smaller than 0.320" less twice the desired coating thickness were chosen. For example, a 3-mil coating was prepared using a 0.310" OD copper tube, and a 12-mil coating was prepared with a 0.292" OD copper tube. The additional 4 mils are based on past experience with tube injections.
4. The copper tube was cleaned with an abrasive sponge, soap, and water.
5. The copper tube and Alloy 625 tube were installed in the injection test fixture. Small metal shims were used at the distal end to center the copper tube inside the Alloy 625 tube.
6. A 5.5:1 mixture of water and phosphoric acid was prepared. 8.5 ml of the solution was mixed with 15 grams of the pre-consolidated formula A powder (unconsolidated formula A powder or mixtures of precon and unconsolidated powders may also be used) for 15–30 seconds. When smooth, (i.e., when a consistency similar to printer's ink was obtained), the mixture was transferred to a 30–50 cc pneumatic syringe/injector.
7. One end of the syringe was connected to the injection fixture and the other to a compressed gas source, typically $N_2$ or He at 120 psia and the mixture was injected into the tube until the mixture was observed exiting from the free annulus away from the pressure source.
8. After separating the tube from the injection fixture, the tubing and formed coating were allowed to stand at room temperature for 24 hours. Some of the coating mixture may ooze from the ends of the tube for about 15–30 minutes. This may reflect pressure relief or escape of gases generated by the chemical reaction.
9. The same heat treatment as was used in preparing the pre-consolidated powder was applied to the coating, except an additional step to heat treat at 290° C. for 1 hour was added to result in complete consolidation.
10. The copper tube was removed by etching with a copper solvent (5% EDTA and 3.5% $H_2O_2$ with pH of 9) at a temperature of less than 100° F. for approximately eight hours. Peroxide addition may be used several times during the first two hours of the etch. Typically, 4 liters of solution is required to etch a single 17" long copper tube with a 0.020" wall.

11. The Alloy 625 tube with coating layer was allowed to air dry.

12. A final cleaning was conducted to remove residual copper using a threaded rod wrapped with steel wool. The steel wool should be pretreated with acetone prior to use in order to remove any wax film.

Upon completion of the formation of the deposit on the inner diameter of the tube sections, the tubes were placed in a thermal-hydraulic flow loop for heat transfer testing. Tests were conducted under saturation conditions at up to 450° F. (232° C.) for up to five days at high heat fluxes. The deposits showed minimal sloughing and overall good adherence. These tests further demonstrated that thinner deposit coatings with porosities in excess of 50% will enhance heat transfer, while thicker less dense deposit coatings impede heat transfer.

While the invention has been described in detail and with reference to specific embodiments thereof, it will be apparent to those of ordinary skill in the art that various changes and modifications can be made to the claimed invention without departing from the spirit and scope thereof.

What we claim:

1. A process for forming an adherent metal oxide coating, with the ability to withstand severe flow boiling conditions of about 200,000 BTU/hr·ft$^2$ heat flux, on a metallic surface consisting essentially of the steps in this order:

(a) providing an oxide mixture consisting of at least one reactive metal oxide selected from the group consisting of iron oxides, nickel oxides, zinc oxides and ferrite compounds, having an average particle diameter of from about 1 to about 10 $\mu$m and an average surface area of from about 0.5 to about 5 m$^2$/gram;

(b) ball milling said oxide mixture in a non-aqueous solvent for at least 24 hours and then drying said oxide mixture to form a dry powder mixture;

(c) combining diluted phosphoric acid with said dry powder mixture to form a coating mixture;

(d) applying said coating mixture to said metallic surface and, (e) heating said metallic surface to form an adherent metal oxide coating on said metallic surface, wherein said phosphoric acid is added in an amount sufficient to produce a porosity of about 20 to about 50% in said adherent metal oxide coating.

2. A process according to claim 1, wherein said reactive metal oxide comprises an iron oxide.

3. A process according to claim 2, wherein said iron oxide comprises $Fe_3O_4$.

4. A process according to claim 2, wherein said iron oxide comprises $Fe_2O_3$.

5. A process according to claim 1, wherein said reactive metal oxide comprises one or more of nickel ferrite and other ferrite compounds.

6. A process according to claim 1, wherein said reactive metal oxide comprises nickel oxide.

7. A process according to claim 1 further comprising combining said oxide mixture with a precursor comprising at least one selected from the group consisting of metals, metal oxides and minerals to provide a precursor mixture, prior to said ball milling of said oxide mixture.

8. A process according to claim 1, further comprising diluting said phosphoric acid to a ratio of about 4:1 to about 7:1, water: 85% orthophosphoric acid.

9. A process according to claim 8, wherein said phosphoric acid is diluted with water to a ratio of about 5.5:1, water: 85% orthophosphoric acid.

10. A process according to claim 8, further comprising forming said coating mixture by combining said diluted phosphoric acid in a ratio of about 0.5 to about 0.7 ml diluted acid to about 1 gram of the dry powder mixture.

11. A process according to claim 1, further comprising adding zinc or iron metal powder to said dry powder mixture, prior to combining said dry powder mixture with said diluted phosphoric acid.

12. A process according to claim 1, further comprising air drying said metal oxide coating.

13. A process according to claim 1, further comprising heating said metal oxide coating to thereby heat treat or harden said metal oxide coating.

14. A process according to claim 13, wherein said heat treating further comprises heating said coating for about 1 to about 4 hours at each of about 90° C., 120° C., 150° C., 190° C., 220° C., 260° C., and 290° C. followed by oven cooling for about 12 hours.

15. A process for forming an adherent metal oxide coating on a metallic surface, with the ability to withstand severe flow boiling conditions of about 200,000 BTU/hr·ft$^2$ heat flux consisting essentially of the steps in this order:

(a) providing a pre-consolidated oxide mixture comprising at least one of zinc metal powder or iron metal powder, and at least one reactive metal oxide selected from the group consisting of iron oxides, nickel oxides, zinc oxides and ferrite compounds, having an average particle diameter of less than 1 $\mu$m to about 10 $\mu$m and an average surface area from about 0.5 to greater than 5 m$^2$/gram;

(b) forming a consolidated oxide mixture combining said pre-consolidated oxide mixture with a concentrated phosphoric acid solution; heat treating the resultant mixture to form a solid mass and grinding and sieving said solid mass to a consolidated oxide mixture;

(c) ball milling said consolidated mixture in a non-aqueous solvent for at least 24 hours and then drying said oxide mixture to form a dry powder mixture;

(d) combining diluted phosphoric acid with said dry powder mixture to form a coating mixture;

(e) applying said coating mixture to said metallic surface and, (f) heating said metallic surface to form an adherent metal oxide coating on said metallic surface, wherein said diluted phosphoric acid is added in an amount sufficient to produce a porosity of about 50 to about 80% in said adherent metal oxide coating.

16. A process according to claim 15, wherein said reactive metal oxide comprises an iron oxide.

17. A process according to claim 16, wherein said iron oxide comprises $Fe_3O_4$.

18. A process according to claim 16, wherein said iron oxide comprises $Fe_2O_3$.

19. A process according to claim 15, further comprising combining said pre-consolidated oxide mixture with a precursor comprising at least one selected from the group consisting of metals, metal oxides and minerals to provide a precursor mixture, prior to combination with said concentrated phosphoric acid.

20. A process according to claim 19, wherein said precursor comprises copper oxides.

21. A process according to claim 15, wherein said concentrated phosphoric acid solution comprises a ratio of about 2:1 to 3:1, water: 85% orthophosphoric acid.

22. A process according to claim 15, further comprising heat treating said pre-consolidated mixture for about 1 to about 4 hours at each of about 90° C., 120° C., 150° C., 190° C., 220° C., and 260° C., followed by oven cooling for about 12 hours.

23. A process according to claim 15, wherein said diluted phosphoric acid is diluted with water to a ratio of about 4:1 to about 7:1, water: 85% orthophosphoric acid.

24. A process according to claim 23, wherein said diluted phosphoric acid is diluted with water to a ratio of about 5.5:1, water: 85% orthophosphoric acid.

25. A process according to claim 24, further comprising forming said coating mixture by combining said diluted phosphoric acid in a ratio of about 0.5 to about 0.7 ml diluted acid to about 1 gram of the dry powder mixture.

* * * * *